US005331754A

United States Patent [19]

Ruvang

[11] Patent Number: 5,331,754

[45] Date of Patent: Jul. 26, 1994

[54] RESILIENT, RATCHETED WEDGE AND SPOOL RETAINING STRUCTURE FOR AN EXCAVATION TOOTH

[75] Inventor: John A. Ruvang, Carrollton, Tex.

[73] Assignee: GH Hensley Industries, Inc., Dallas, Tex.

[21] Appl. No.: 38,538

[22] Filed: Mar. 29, 1993

[51] Int. Cl.[5] ..... E02F 9/28

[52] U.S. Cl. ..... 37/457; 37/455

[58] Field of Search ..... 37/455–459; 172/772, 719; 299/92; 411/512

[56] References Cited

U.S. PATENT DOCUMENTS

| | | | |
|---|---|---|---|
| 790,996 | 5/1904 | Keller . | |
| 911,586 | 2/1909 | French . | |
| 2,919,506 | 1/1960 | Larsen . | |
| 2,949,687 | 4/1960 | Peklay et al. | 37/457 |
| 3,012,346 | 12/1961 | Larsen . | |
| 3,126,654 | 3/1964 | Eyolfson et al. . | |
| 3,572,785 | 3/1971 | Larson . | |
| 3,722,932 | 3/1973 | Dougall . | |
| 3,864,854 | 2/1975 | Evans . | |
| 4,061,432 | 12/1977 | Hahn et al. . | |
| 4,187,035 | 2/1980 | Colburn | 37/458 |
| 4,267,653 | 5/1981 | Hahn et al. . | |
| 4,271,615 | 6/1981 | Jones . | |
| 4,282,665 | 8/1981 | Fletcher et al. . | |
| 4,413,432 | 11/1983 | Bierwith . | |
| 4,414,764 | 11/1983 | Johansson et al. . | |
| 4,626,034 | 12/1986 | Breuer et al. . | |
| 4,650,255 | 3/1987 | Staroba . | |
| 4,663,867 | 5/1987 | Hahn et al. . | |
| 5,134,793 | 8/1992 | Bierwith . | |
| 5,144,762 | 9/1992 | Robinson | 37/457 |

*Primary Examiner*—Randolph A. Reese

*Assistant Examiner*—Spencer K. Warnick

*Attorney, Agent, or Firm*—Konneker Bush Hitt & Chwang

[57] ABSTRACT

An elongated resilient wedge and spool retaining structure longitudinally extends through generally aligned openings formed in a replaceable excavating tooth point, and an adapter nose portion received in a tapered socket within the tooth point, to captively hold the tooth point in place on the adapter nose. The retaining structure includes a tapered spool member having an enlarged side portion received in the tooth socket and blocking removal of the spool member, and a tapered wedge member driven into the tooth and adapter openings to a position in which longitudinally extending series of ratchet teeth on facing sides of the spool and wedge members are intermeshed and releasably lock the structure in place within the tooth and adapter assembly. A recess formed in a nontoothed side of the wedge member receives a locking member that forcibly bears against a surface portion of the adapter nose opening and is movable into the recess in a manner compressing a plurality of elastomeric members therein. The elastomeric members are maintained in compression and exert resilient reactive forces that simultaneously act to draw the adapter nose into the tooth socket and forcibly hold the spool and wedge member ratchet teeth in intermeshed engagement with one another. A removal tool may be driven into a longitudinal passage extending through the retaining structure, centrally through the intermeshed series of ratchet teeth, to laterally separate the wedge member from the spool member and thereby facilitate the removal of the installed wedge member.

21 Claims, 1 Drawing Sheet

RESILIENT, RATCHETED WEDGE AND SPOOL RETAINING STRUCTURE FOR AN EXCAVATION TOOTH

BACKGROUND OF THE INVENTION

The present invention relates generally to earth excavating equipment, and more particularly relates to apparatus for captively retaining a replaceable excavating tooth point on the nose portion of an adapter which, in turn, is secured to the forward lip of an excavating bucket or the like.

Socketed tooth points used in excavation operations are typically relaceably mounted on adapter nose portions of, for example, excavation buckets by inserting the nose portions into the tooth sockets and retaining each tooth on its associated adapter nose portion using a removable connector structure driven into generally aligned openings formed in the tooth and nose portion.

These connector structures typically come in two forms—(1) wedge and spool connectors and (2) flex pin connectors. A wedge and spool connector comprises a tapered spool portion which is initially placed in the aligned tooth and adapter nose openings, and a tapered wedge portion which is subsequently driven into the openings, against the spool portion, to jam the structure in place within the openings in a manner exerting high rigid retention forces on the interior opening surfaces and press the nose portion into a tight fitting engagement with the tooth socket.

Very high drive-in and knock-out forces are required to insert and later remove the steel wedge and typically require a two man effort to pound the wedge in and out—one man holding a removal tool against an end of the wedge, and the other man pounding on the removal tool with a sledge hammer. This creates a safety hazard due to the possibility of flying metal slivers and/or the second man hitting the first man instead of the removal tool with the sledge hammer. Additionally, wear between the tooth/adapter nose surface interface during excavation use of the tooth tends to loosen the tight fit of the wedge/spool structure within the tooth and adapter nose openings, thereby permitting the wedge/-spool structure to fall out of the openings and thus permitting the tooth to fall off the adapter nose.

Flex pin structures typically comprise two elongated metal members held in a spaced apart, side-by-side orientation by an elastomeric material bonded therebetween. The flex pin structure is longitudinally driven into the tooth and adapter nose openings to cause the elastomeric material to be compressed and resiliently force the metal members against the nose and tooth opening surfaces to retain the connector structure in place within the openings and resiliently press the adapter nose portion into tight fitting engagement with the interior surface of the tooth socket.

Flex pins also have their disadvantages. For example, compared to wedge/spool structures they have a substantially lower in-place retention force. Additionally, reverse loading on the tooth creates a gap in the tooth and adapter nose openings through which dirt can enter the tooth pocket and undesirably accelerate wear at the tooth/adapter nose surface interface which correspondingly loosens the connector retention force.

It can be seen from the foregoing that it would be desirable to provide improved excavating tooth connector apparatus that eliminates or at least substantially reduces the above-mentioned problems, limitations and disadvantages associated with conventional excavating tooth connector apparatus. It is accordingly an object of the present invention to provide such improved connector apparatus.

SUMMARY OF THE INVENTION

In carrying out principles of the present invention, in accordance with a preferred embodiment thereof, a resilient wedge and spool retaining structure is provided for captively retaining a replaceable tooth point on an adapter portion of an excavating tooth and adapter assembly in which the adapter portion is removably received in a tapered socket within the tooth point, the tooth point and the adapter portion received therein having generally aligned openings extending therethrough.

The retaining structure comprises an elongated spool member longitudinally insertable into the tooth point and adapter portion openings and having first and second ends and oppositely facing first and second sides. The first side has a longitudinally intermediate portion on which a lateral projection is formed. The lateral projection is receivable in the tooth point socket to block longitudinal removal of the inserted spool member from the tooth point and adapter portion openings. The second side of the spool member extends from the first spool member end to the second spool member end, is longitudinally inclined relative to the first spool member side, and has formed thereon a longitudinally extending series of first ratchet teeth, each of which is transverse to the length of the spool member.

Preferably, the series of first ratchet teeth extends along essentially the entire length of the second spool member side. Additionally , a first longitudinal groove, representatively having a semicircular cross-section along its length, is formed in the second spool member side and extends centrally through the series of first ratchet teeth from the first end of the spool member to its second end. In the preferred embodiment of the retaining structure, each of the first ratchet teeth has a ramped abutment surface, and an abutment surface generally perpendicular to the length of the spool member.

The retaining structure also comprises an elongated wedge member having first and second ends, a locking side having a recess formed therein and having an inner side surface, and a spool engagement side opposite the locking side. The spool engagement side extends between the first and second ends of the wedge member and is longitudinally inclined relative to the locking side of the wedge member. A longitudinally extending series of second ratchet teeth are formed on the spool engagement side of the wedge member, with each of the second ratchet teeth being transverse to the length of the wedge member.

Preferably, the series of second ratchet teeth extends along essentially the entire length of the spool engagement side of the wedge member. Additionally, a second longitudinal groove, representatively having a semicircular cross-section along its length, is formed in the spool engagement side of the wedge member and extends centrally through the series of second ratchet teeth from the first end of the wedge member to its second end. In the preferred embodiment of the retaining structure, each of the second ratchet teeth has a ramped abutment surface, and an abutment surface generally perpendicular to the length of the wedge member.

A locking member is received in the wedge member locking side recess and projects outwardly beyond the locking side, the locking member being movably in the recess toward and away from its inner side surface. At least one resilient member, representatively in the form of a plurality of elastomeric members, is intersecured between the locking member and the inner side surface of the wedge member recess and is operative to resiliently resist movement of the locking member toward the inner side surface of the wedge recess.

According to other aspects of the present invention at least one rigid stop portion is formed on the inner side surface of the wedge member recess and serves as an abutment that limits the movement of the locking member into the wedge member recess in a manner such that the maximum compression of the elastomeric members is about fifty percent. Additionally, the wedge member recess is provided with opposite end surfaces that are positioned to engage the locking member and limit its movement relative to the wedge member in directions parallel to the length of the wedge member.

The wedge member is longitudinally drivable into the tooth and adapter openings, subsequent to the operative insertion of the spool member therein, to intermesh the series of first and second ratchet teeth and forcibly engage the locking member with a front surface portion of the adapter portion opening in a manner maintaining the elastomeric members in compression to thereby create resilient reactive forces in the installed wedge and spool retaining structure which simultaneously act to draw the adapter portion into the tooth socket and forcibly hold the series of first and second ratchet teeth in intermeshed engagement to releasably lock the wedge and spool retaining structure in place with the overall excavating tooth and adapter assembly.

In the installed wedge and spool retaining structure the first and second longitudinal grooves respectively formed in the spool and wedge members combinatively define a longitudinally extending passage within the retaining structure. A portion of a suitable removal tool, having a cross-section larger than that of the passage, may be driven into the passage to laterally separate the wedge member from the spool member to facilitate the removal of the wedge member from the tooth and adapter portion openings.

According to another aspect of the present invention the tooth and adapter openings, and the spool and wedge members insertable therein, are relatively configured in a manner preventing a laterally reversed installation of the spool and wedge members in the tooth and adapter openings. Preferably, the locking member, the elastomeric members and the rigid stop portion within the wedge recess are relatively configured in a manner such that when the retaining structure is initially installed the elastomeric members are compressed by about thirty five percent.

DETAILED DESCRIPTION

Figure 1:
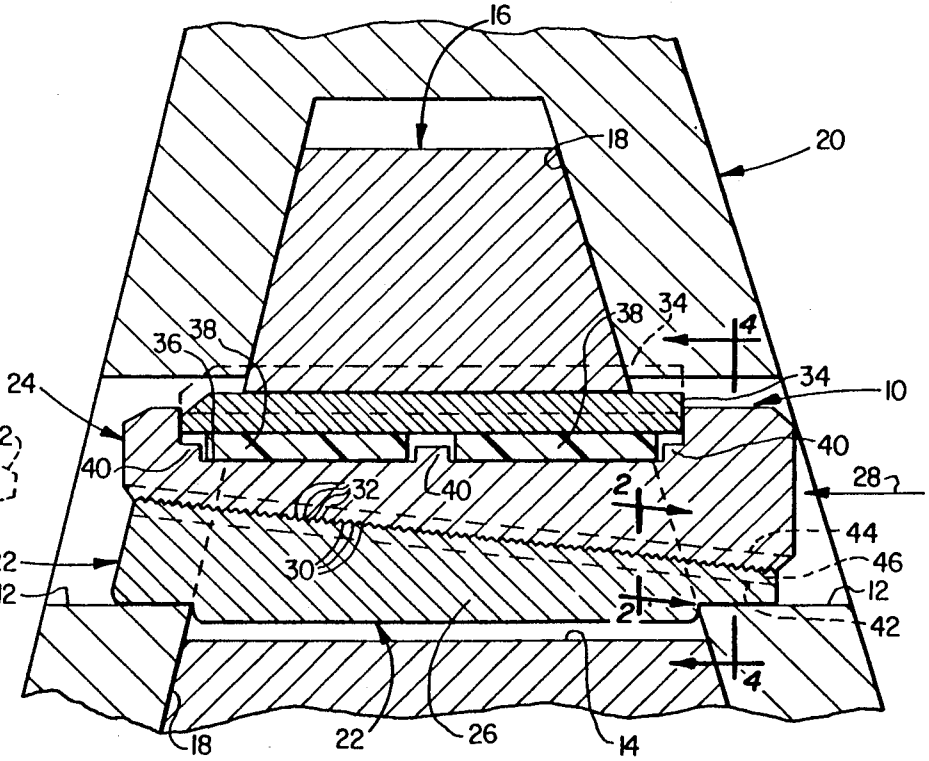
FIG. 1 is a partial cross-sectional view through a front portion of an excavating tooth and adapter assembly incorporating therein a unique resilient, ratcheted wedge and spool retaining structure embodying principles of the present invention.

Referring initially to FIG. 1, the present invention provides a resilient, ratcheted wedge and spool structure 10 that is extended through generally aligned tooth and adapter nose openings 12,14 to retain an adapter nose portion 16 within the tapered socket 18 of a replaceable excavation tooth point 20. The adapter nose 16 is an outwardly projecting portion of a larger adapter body (not shown) secured, for example, to a lower front edge portion of an excavation bucket (not shown). The wedge and spool structure 10 includes an elongated tapered metal spool portion 22 and an elongated tapered metal wedge portion 24.

To install the structure 10, which captively and removably retains the replaceable tooth 20 on the adapter nose 16, the spool 22 is longitudinally inserted into the openings 12,14 to position a laterally enlarged longitudinally central portion 26 of the spool within the socket 18, between opposite interior side surface portions of the adapter nose 16, to lock the spool 22 against horizontal removal from the openings 12,14. Next, the wedge 24 is leftwardly inserted into the openings 12 and 14, above the spool 22, and driven leftwardly into place as indicated by the arrow 28.

Figure 3:
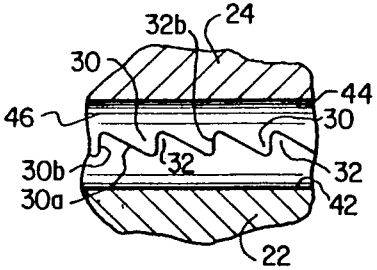
FIG. 3 is an enlarged scale cross-sectional view through the retaining structure taken along line 3—3 of FIG. 2.

The driven movement of the wedge 24 cammingly advances ratchet teeth 30 on the bottom or spool engagement side of the wedge along corresponding ratchet teeth 32 on the top side of the spool 22, against a subsequently described resilient lateral retention force incorporated in the wedge 24, until the wedge is operatively inserted in the openings 12,14. As illustrated in FIG. 3, the interlocked ratchet teeth 30,32 have abutting ramped surface portions **30*a*,32*a* and abutting portions 30*b*,32*b* that extend generally perpendicularly to the lengths of the wedge and spool and prevent rightward removal of the structure 10 from the openings 12,14 when the structure 10 is wedged therein as shown in FIG. 1**.

As the wedge 24 reaches its illustrated position within openings 12,14 an elongated metal bar portion 34 of the wedge is laterally driven from its initial dotted line position into a forwardly opening top or locking side recess 36 formed in the wedge member 24 against the resiliently resistive force of a pair of elastomeric members 38 positioned in the recess between upwardly extending stop portions 40 formed in the recess. In the installed wedge/spool structure 10, the resilient upward force of the metal bar 36 on the top side surface of the adapter nose opening 14, coupled with the resilient downward force of the spool 22 on the bottom side surfaces of the tooth opening 12, presses the adapter nose upwardly into the tooth socket 18.

This resilient force, of course, also has a downwardly directed reactive component which serves to maintain the "one way" wedge and spool ratchet teeth 30,32 in releasably locked interengagement. While the wedge 24 is being driven leftwardly into place, the elastomeric wedge members 38 are also cyclically compressed as the wedge teeth 30 are resiliently ratcheted over the underlying spool teeth 32. While the elastomeric members 38 are quite suitable for their intended task, it will be appreciated that other types of resilient members, such as springs, could be used in place thereof.

Figure 2:
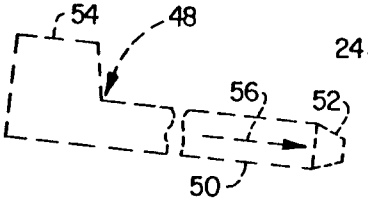
FIG. 2 is an enlarged scale partial cross-sectional view through the retaining structure taken along line 2—2 of FIG. 1.
Figure 2:
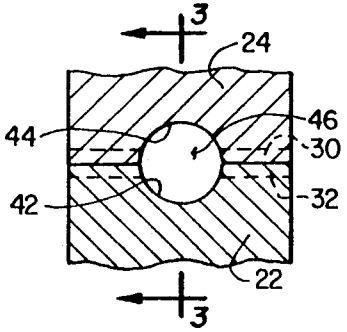

As illustrated in FIGS. 1 and 2, laterally facing, generally semicircular grooves 42,44 respectively cut into the top side of the spool 22 and the bottom side of the wedge 24 define a circularly cross-sectioned interior passage 46 extending through the wedge/spool structure 10 between its opposite ends. This passage 46 substantially facilitates the removal of the structure 10 from the tooth and adapter nose openings 12,14 using a simple removal tool 48 (see FIG. 1) having an elongated cylindrical rod portion 50 with a diameter greater than that of the passage 46 and a tapered front end 52, and a block portion 54 secured to the rear end of the rod 50.

The removal tool 48 is used by inserting the tapered right end 52 rightwardly into the passage 46 and tapping rightwardly on the block, as indicated by the arrow 56 in FIG. 1, to drive the rod rightwardly through the passage 46. As the rod 50 moves rightwardly through the passage 46 it laterally separates the wedge 24 from the spool 22, thereby disengaging the teeth 30 from the teeth 32. When the block 54 is brought into contact with the left end of the wedge 24, further tapping on the block 54 rightwardly drives the wedge out of the openings 12,14 to permit easy removal of the wedge/spool structure 10 therefrom.

Compared to both conventional wedge and spool connectors and flex pin connectors the resilient, ratcheted wedge and spool retaining structure 10 of the present invention provides a variety of advantages. For example, compared to rigid wedge and spool retention structures the structure 10 provides substantially lowered wedge drive-in and drive-out forces due to the lateral resiliency provided by the elastomeric members 38 built into the nontoothed side of the wedge 24. This facilitates the installation and removal of the wedge to the extent that these tasks may be easily carried out by a single worker. Additionally, the substantially lessened wedge drive-in and drive-out force required enhances the handling safety associated with the wedge/spool structure 10.

Compared to conventional flex pin connectors the wedge/spool structure 10, when operatively installed, has a higher amount of residual resilient force operative to maintain the adapter nose portion 16 in seated engagement with the interior surface of the tooth socket 18. This is due to the fact that in addition to the lateral compression distance of the elastomeric members 38 arising from the downward installation movement of the locking member 34 from its dotted line position to its solid line position in FIG. 1, only a slight additional lateral compression of the members 38 is created by the wedge and spool teeth 30,32 as they ratchet into place—this additional compression distance being equal to the depth of such teeth.

Accordingly, when the wedge 24 reaches its final installation position, and this relatively small additional compression of the members 38 is eliminated, the considerably greater compression of the members 38 by the locking bar 34 still remains. During wedge installation the side portion 26 of the spool 22 is already locked into place—it does not have to be cammed upwardly against the resilient force of the elastomeric members 38 and then allowed to snap downwardly into place in the socket 18, thereby substantially reducing the available residual retention force of the resilient portion of the retention structure as is typical with conventional flex pin connectors.

This higher resilient force retained in the installed wedge/spool structure 10 maintains the adapter nose portion 16 in firm contact with the interior surface of the tapered tooth socket 18, and additionally serves to automatically shift the adapter nose upwardly into the tooth socket as the socket/adapter surface interface area begins to wear during use of the tooth/adapter assembly. Since the residual retention force is increased in the present invention, the available length of this wear adjustment shift is correspondingly increased, thereby lengthening the useful operating life of the adapter nose 16.

With respect to the lateral compression of the elastomeric wedge members 38, the preferred range of their lateral compression in the present invention is from about 35% (when the structure 10 is initially installed) to about 50% when, during reverse loading on the tooth 20 the locking bar 34 is downwardly driven into rigid contact with the stop portions 40 within the side recess 36 of the wedge 24. The stop portions 40 thus serve as rigid abutments that prevent undesirable overcompression of the elastomeric members 38 during use of the tooth and adapter assembly. Additionally, as shown in FIG. 1, the wedge recess 36 has opposite end surfaces that act as abutments for the opposite ends of the locking bar 34 to limit its movement relative to the wedge member 24 in directions parallel to the length of the wedge member.

Referring again to FIGS. 1 and 2, the laterally facing grooves 42,44 respectively formed in the spool 22 and the wedge 24 extend the full lengths of these members and pass through their ratchet teeth 32 and 30, dividing each tooth set into separate sections positioned on opposite sides of the removal tool passage 46 as best illustrated in FIG. 2. Accordingly, the tool 48 does not come into contact with, and potentially damage any of the ratchet teeth when it is used to laterally separate the wedge 24 from the spool 22 as previously described.

Another advantage provided by the unique configuration of the resilient wedge/spool structure 10 is its positioning of the locking bar 34, and its associated elastomeric members 38, on the back or nontoothed side of the wedge 24. This permits the series of ratchet teeth 30,32 to be extended along essentially the entire facing sides of the wedge 24 and the spool 22 as best illustrated in FIG. 1. In turn, this increases the available tooth interlocking area and thus the tooth contact area that inhibits rightward dislodgement of the installed wedge 24. Moreover, the ability to extend the ratchet teeth along essentially the entire lengths of the wedge and spool allows the depths of the teeth to be kept relatively small to thereby permit a greater resilient connection force, as previously discussed herein, to remain in the wedge/spool structure 10 after it is operatively installed.

Figure 4:
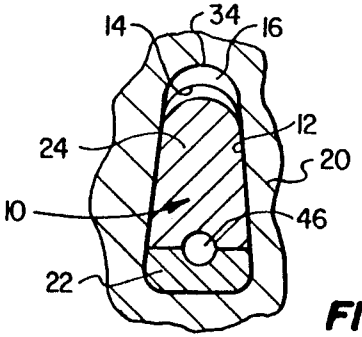
FIG. 4 is a partial cross-sectional view through the excavating tooth and adapter assembly taken along line 4—4 of FIG. 1.

A further feature incorporated in the resilient wedge/spool structure 10 is best illustrated in FIG. 4. As can be seen in that drawing figure, the tooth and adapter openings 12 and 14 have generally trapezoidal configurations with generally flat bottom sides and narrowed, curved upper ends. Cross-sectionally, the interlocked spool and wedge 22,24 have the same configuration as these openings which receive them. Accordingly, as can be seen in FIG. 4, the complementarily shaped wedge/spool structure 10 and openings 12,14 conveniently prevent the wedge and spool from being inadvertently installed in reversed orientation—i.e., with the wedge 24 beneath the spool 22 as viewed in FIGS. 1 and 4.

The foregoing detailed description is to be clearly understood as being given by way of illustration and example only, the spirit and scope of the present invention being limited solely by the appended claims.

What is claimed is:

1. For use in captively retaining a replaceable tooth point on an adapter portion of an excavating tooth and adapter assembly in which the adapter portion is removably received in a tapered socket within the tooth point, the tooth point and the adapter portion received therein having generally aligned openings extending therethrough, a resilient wedge and spool retaining structure comprising:

an elongated spool member longitudinally insertable into the tooth point and adapter portion openings, said spool member having:

first and second ends, a first side on a longitudinally intermediate portion of which a lateral projection is formed, said lateral projection being receivable in the tooth point socket to block longitudinal removal of the inserted spool member from the tooth point and adapter portion openings, a second side opposite said first side, said second side extending from said first end to said second end and being longitudinally inclined relative to said first side, and a longitudinally extending series of first ratchet teeth formed on said second side, each of said first ratchet teeth being transverse to the length of said spool member;

an elongated wedge member having:

first and second ends, a locking side having a recess formed therein and having an inner side surface, a spool engagement side opposite said locking side, said spool engagement side extending between said first and second ends of said wedge member and being longitudinally inclined relative to said locking side, and a longitudinally extending series of second ratchet teeth formed on said spool engagement side, each of said second ratchet teeth being transverse to the length of said wedge member;

a locking member received in said recess and projecting outwardly beyond said locking side, said locking member being movable in said recess toward and away from said inner side surface thereof; and at least one resilient member intersecured between said locking member and said inner side surface of said recess and operative to resiliently resist movement of said locking member toward said inner side surface of said recess, said wedge member being drivable into the tooth and adapter openings, subsequent to the operative insertion of said spool member therein, to intermesh said first and second ratchet teeth and forcibly engage said locking member with a surface portion of the adapter portion opening in a manner maintaining said at least one resilient member in compression to thereby create resilient reactive forces in said wedge and spool retaining structure which simultaneously act to draw the adapter portion into the tooth socket and forcibly hold said first and second ratchet teeth in intermeshed engagement.

2. The resilient wedge and spool retaining structure of claim 1 wherein:

said longitudinally extending series of first ratchet teeth formed on said second side of said spool member extends along essentially the entire length of said second side, and said longitudinally extending series of second ratchet teeth formed on said spool engagement side of said wedge member extends along essentially the entire length of said spool engagement side.

3. The resilient wedge and spool retaining structure of claim 2 wherein:

said first and second ratchet teeth, respectively, have abutment surfaces generally perpendicular to said spool and wedge members.

4. The resilient wedge and spool retaining structure of claim 2 further comprising:

a first longitudinal groove formed on said second side of said spool member and extending centrally through said first ratchet teeth from said first end of said spool member to said second end of said spool member, and a second longitudinal groove formed on said spool engagement side of said wedge member and extending centrally through said second ratchet teeth from said first end of said wedge member to said second end of said wedge member, said first and second longitudinal grooves combinatively defining in the operatively installed wedge and spool retaining structure an interior passage into which a portion of a removal tool may be driven to laterally separate said wedge member from said spool member to facilitate the removal of said wedge member from the tooth and adapter portion openings.

5. The resilient wedge and spool retaining structure of claim 4 wherein:

said first and second longitudinal grooves have generally semicircular cross-sections along their lengths.

6. The resilient wedge and spool retaining structure of claim 1 further comprising:

at least one rigid stop portion formed on said inner side surface of said wedge member recess and operative to limit the inward movement of said locking member into said recess to correspondingly limit the maximum compression of said at least one resilient member.

7. The resilient wedge and spool retaining structure of claim 6 wherein:

said at least one rigid stop portion is configured to limit the compression of said at least one resilient member to about fifty percent.

8. The resilient wedge and spool retaining structure of claim 7 wherein:

said locking member and said at least one resilient member are relatively configured in a manner such that when said wedge and spool retaining structure is initially installed in the tooth and adapter openings said at least one resilient member is compressed about thirty five percent.

9. The resilient wedge and spool retaining structure of claim 1 wherein:

said at least one resilient member comprises a plurality of elastomeric members.

10. The resilient wedge and spool retaining structure of claim 1 wherein:

said wedge member recess has opposite end surfaces positioned to engage said locking member and limit its movement relative to said wedge member in directions parallel to the length of said wedge member.

11. An excavating tooth and adapter assembly comprising:

a replaceable tooth point having a socket opening extending forwardly through a rear end thereof and being circumscribed by a laterally outer wall portion of said tooth point, and an aligned pair of connector openings formed through opposed sections of said laterally outer wall portion;

an adapter having a forwardly projecting nose portion received in said socket opening and bearing against a side surface portion thereof, said nose portion having a connector opening extending transversely therethrough and positioned between said tooth point connector openings in general alignment therewith; and an elongated resilient wedge and spool retaining structure longitudinally extending through said tooth point and nose portion connector openings, said wedge and spool retaining structure captively and removably retaining said tooth point on said adapter nose portion and including:

an elongated spool member longitudinally extending through said tooth point and adapter nose connector openings and having (1) first and second ends, (2) a rear side with opposite end portions bearing against rear surface portions of said tooth point connector openings, and an outwardly projecting longitudinally intermediate portion received in said socket opening and blocking longitudinal removal of said spool member from said tooth point and adapter nose connector openings, (3) a front side extending between said first and second ends and being longitudinally inclined relative to said rear side, and (4) a longitudinally extending series of first ratchet teeth formed on said front side, each of said first ratchet teeth being transverse to the length of said spool member, an elongated wedge member longitudinally extending through said tooth point and nose portion connector openings, forwardly of said spool member, said wedge member having (1) first and second ends, (2) a front side having a recess formed therein and having an inner side surface, (3) a rear side extending between said first and second ends of said wedge member and being longitudinally inclined relative to said front side of said wedge member, and (4) a longitudinally extending series of second ratchet teeth formed on said rear side of said wedge member, each of said second ratchet teeth being transverse to the length of said wedge member, said series of first and second ratchet teeth being in an intermeshed engagement with one another and inhibiting longitudinal removal of said wedge member from said tooth point and adapter nose portion connector openings, a locking member received in said recess, projecting forwardly beyond said front side of said wedge member, and being movable through said recess toward said inner side surface thereof, and at least one resilient member intersecured between said locking member and said inner side surface of said recess, said at least one resilient member being compressed between said locking member and said inner side surface of said recess and exerting reactive forces acting to draw said adapter nose portion into said tooth point socket opening and to forcibly hold said series of first and second ratchet teeth in intermeshed engagement with one another.

12. The excavating tooth and adapter assembly of claim 11 wherein:

said longitudinally extending series of first ratchet teeth formed on said front side of said spool member extends along essentially the entire length thereof, and said longitudinally extending series of second ratchet teeth formed on said rear side of said wedge member extends along essentially the entire length thereof.

13. The excavating tooth and adapter assembly of claim 12 wherein:

said first and second ratchet teeth, respectively, have abutment surfaces generally perpendicular to said spool and wedge members.

14. The excavating tooth and adapter assembly of claim 12 further comprising:

a first longitudinal groove formed on said front side of said spool member and extending centrally through said first ratchet teeth from said first end of said spool member to said second end of said spool member, and a second longitudinal groove formed on said rear side of said wedge member and extending centrally through said second ratchet teeth from said first end of said wedge member to said second end of said wedge member, said first and second longitudinal grooves combinatively defining in said resilient wedge and spool retaining structure an interior passage into which a portion of a removal tool may be driven to laterally separate said wedge member from said spool member to facilitate the removal of said wedge member from the tooth point and adapter nose portion connector openings.

15. The excavating tooth and adapter assembly of claim 14 wherein:

said first and second longitudinal grooves have generally semicircular cross-sections along their lengths.

16. The excavating tooth and adapter assembly of claim 11 further comprising:

at least one rigid stop portion formed on said inner side surface of said wedge member recess and operative to limit the inward movement of said locking member into said recess to correspondingly limit the maximum compression of said at least one resilient member.

17. The excavating tooth and adapter assembly of claim 16 wherein:

said at least one rigid stop portion is configured to limit the compression of said at least one resilient member to about fifty percent.

18. The excavating tooth and adapter assembly of claim 17 wherein:

said locking member and said at least one resilient member are relatively configured in a manner such that when said wedge and spool retaining structure is initially installed in the tooth point and adapter nose portion connector openings said at least one resilient is compressed about thirty five percent.

19. The excavating tooth and adapter assembly of claim 11 wherein:

said at least one resilient member comprises a plurality of elastomeric members.

20. The excavating tooth and adapter assembly of claim 11 wherein:

said wedge member recess has opposite end surfaces positioned to engage said locking member and limit its movement relative to said wedge member in directions parallel to the length of said wedge member.

21. The excavating tooth and adapter assembly of claim 11 wherein:

said tooth point and adapter nose portion connector openings, and said spool and wedge members extending therethrough, are relatively configured in a manner preventing a laterally reversed installation of said spool and wedge members in said tooth point and adapter nose portion connector openings.

* * * * *